US006588696B1

(12) United States Patent
Riihelä et al.

(10) Patent No.: US 6,588,696 B1
(45) Date of Patent: Jul. 8, 2003

(54) METHOD AND APPARATUS IN UNWINDING

(75) Inventors: Vesa Riihelä , Järvenpää (FI); Timo Eskola, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/623,721

(22) PCT Filed: Dec. 28, 1999

(86) PCT No.: PCT/FI99/01081

§ 371 (c)(1),
(2), (4) Date: Aug. 31, 2000

(87) PCT Pub. No.: WO00/40491

PCT Pub. Date: Jul. 13, 2000

(30) Foreign Application Priority Data

Dec. 31, 1998 (FI) ..... 982842

(51) Int. Cl.[7] ..... B65H 19/10

(52) U.S. Cl. ..... 242/554.5; 242/555.3; 242/563; 242/563.2

(58) Field of Search ..... 242/555.3, 555.5, 242/554.5, 554.6, 563.2, 563

(56) References Cited

U.S. PATENT DOCUMENTS

| | | | | |
|---|---|---|---|---|
| 4,021,002 A | | 5/1977 | Meihofer | 242/58.1 |
| 4,077,580 A | | 3/1978 | Lang et al. | 242/58.2 |
| 4,089,482 A | | 5/1978 | Mooney et al. | 242/58.1 |
| 4,337,903 A | | 7/1982 | Kessler et al. | 242/56 |
| 4,432,481 A | | 2/1984 | Miller | 226/9 |
| 5,437,749 A | | 8/1995 | Pipkorn et al. | 156/64 |
| 5,709,355 A | | 1/1998 | Kinnunen et al. | 242/555.3 |
| 5,797,561 A | | 8/1998 | Madrrzak | 242/554.6 |
| 6,096,150 A | * | 8/2000 | Ohno | 242/555.5 |

FOREIGN PATENT DOCUMENTS

| | | |
|---|---|---|
| EP | 0819639 | 1/1998 |

* cited by examiner

*Primary Examiner*—John Q. Nguyen
(74) *Attorney, Agent, or Firm*—Steinberg & Raskin, P.C.

(57) ABSTRACT

In the method in unwinding, paper web (W) is discharged from a reel (R1) that is becoming empty and the paper web of a new full reel (R2) is spliced at the discharge speed to the paper web discharged from the reel that is becoming empty. The terminal end point (L) of the web of the reel (R1) that is becoming empty is stored as information indicating its position in the longitudinal direction of the web in a readable memory (M) corresponding to the reel. During the discharge the distance travelled by the web is determined and compared to the memory, and when there is a predetermined length of web to the terminal end point (L) remaining on the reel (R1) that is becoming empty, a splicing command is given, whereafter the leading end of the paper web of a new full reel (R2) is spliced to the paper web (W) being discharged.

18 Claims, 2 Drawing Sheets

METHOD AND APPARATUS IN UNWINDING

FIELD OF THE INVENTION

The invention relates to a method and apparatus in unwinding. The invention relates to the splicing phase of a continuous unwind, in which the web of a new machine reel brought to the unwind is attached at full speed to the web of the machine reel that is becoming empty by cutting the web and pressing the web of the machine reel that is becoming empty against the splice in the new machine reel.

BACKGROUND OF THE INVENTION

In off-machine coating machines for paper, a continuous unwind is used in which a new, full machine reel that is brought to the unwind is attached to the end of the paper web in the machine reel that is becoming empty. In present-day fast coating machines the splicing method is essentially the same, i.e. a splice is prepared in the leading end of the web of a new machine reel by means of a two-sided adhesive tape, the splice being attached on the surface of the reel by pieces of fastening tape. The surface speed of the new machine reel is accelerated to be equal to the running speed of the machine, i.e. the web speed of the paper web discharged from the reel, whereafter the web of the reel becoming empty is pressed against the aforementioned splice for example by means of a roll or a brush. The old web is cut with a blade above the splice.

The splicing in an unwind has become problematic at current running speeds (1200–1600 m/min). Therefore, the running speed of the coating machine often has to be dropped for the duration of the splicing. A negative pressure is generated in the so-called splicing gap between the splicing roll and the machine reel, which are brought close to each other at high speed, which negative pressure can be pulsating if the new machine reel is out-of-round. The negative pressure tends to draw the old web partly against the splice already before the splicing, and causes fluttering of the old web. Furthermore, the negative pressure tends to detach the tape splice from the surface of the new machine reel, wherein the new machine reel opens before splicing. In order to make the web travel in a controlled manner, a bend is necessary at the splicing roll, which, in turn, requires stretching of the web, when the splicing roll is rapidly struck against the surface of the machine reel. The aim is to keep the tension peak caused by the stroke of the roll on a low level, by using a small splicing gap (8 to 12 mm), which causes a strong phenomenon of negative pressure. Even the currently used bending angle causes a problematic tension peak in the web. At higher running speeds, an even larger bending angle would be necessary.

A solution to this problem is presented in the Finnish patent 100323, and in the related U.S. Pat. No. 5,709,355. The splicing device comprises a splicing roll, by means of which the the web of the machine reel that is becoming empty is pressed against the splice in the new machine reel, and at least one auxiliary roll. The splicing roll and the auxiliary roll are attached to a lever device, which is journalled at an articulation point between the axes of the rolls in such a way that before the splicing and in the splicing the web travels in such a manner that the length of the web is substantially the same both in the splicing position and in the basic position of said rolls.

The aforementioned solution has made it possible to eliminate the problems occurring in the vicinity of the splicing gap, and it enables a splicing with high running speeds of even over 1600 m/min. In the so-called flying splicing described above, the control of the cut tail of the old reel spool has become problematic at high running speeds and especially in connection with heavy paper grades. After the splicing, the aim is to rapidly stop the reel spool that has formed the core of the reel. The paper left on the reel spool must not be discharged therefrom to such an extent that it cannot be controlled by means of air blows. The discharged paper web as well as the pieces, so-called chaff, detached therefrom, tend to enter the nip between the splicing roll and the machine reel rotating in the primary station. This will almost always cause a break at the splicing device. Moreover, pieces detached from the web often travel along with the air currents on top of the web (e.g. from the sides of the machine), which also causes a break. By means of air jets it is not possible to fully control the paper travelling at high speed and the pieces detached therefrom.

The length of the paper discharged after cutting from the reel spool that is becoming empty is proportional to the gravity of the problem. In constructions currently in use, the aim is to minimize the length of the discharged paper with a shortest possible braking time. However, the braking time is increasing, because the speeds of the machines are growing, and as the sizes of the machine reels grow, the diameters of the reel spools grow as well. Even the present-day speeds and diameters of the reel spools set high demands on the braking devices, and the brakes have to be maintained and changed often, which increases the operating costs.

OBJECTS AND SUMMARY OF THE INVENTION

It is an aim of the invention to eliminate the aforementioned drawbacks and to present a method and apparatus, by means of which the problems caused by the splicing and the paper discharged after cutting can be avoided.

The invention is based on the idea that the end point of the dischargeable web on the reel is stored in a memory, which indicates the location of the end point in the longitudinal direction of the web, and when the web is discharged from the reel, the length of the discharged web is simultaneously monitored and compared to the memory. The comparison indicates the remaining amount of paper in linear measure units. When the end point of the web is approaching, it is possible to give a splicing command when a predetermined length is left on the reel. Thus, the rest of the length of the web on the reel that is becoming empty can be minimized, and this short web section which can still issue from the roll can be controlled more easily.

In practice it is possible to proceed in such a manner that for example in a rereeler before the coating machine after the tail threading, an attachment point for the web is produced on the bottom of the machine reel, for example a two-sided tape, or glue is fed thereto. The end point of the web can be attached either on the surface of the reel spool or on the paper layers on the bottom after a few windings, wherein the adhesive substances do not enter in contact with the surface of the roll.

Thereafter the person operating the machine performs the necessary steps by means of a storing device, for example a terminal. The attachment point is transferred to the memory as a position information indicating its location in the longitudinal direction of the machine.

Each machine reel is allotted a memory of its own, which can be read later under the control of a program in connection with unwinding. It is possible to use for example a fault map known as such as the memory. Thanks to an identification system for the machine reel, the reel is automatically accompanied with the machine reel specific fault map when passed to the unwinding for the paper coating machine. The edge of the paper is provided with locating marks at regular intervals, as well as beginning and end marks of the reel, by means of which the fault map is synchronized in the unwinding. In this system, the point in which the unwinding of the reel is proceeding is known with the accuracy of 1 to 2 m.

The invention is utilized to set the time of the splicing in the unwinding. The system gives advance information in the form of a signal when the end point of the web is approaching. On the basis of this information, the drive is capable of accelerating the full machine reel to the web speed at the correct time. Another signal gives a splicing command, whereafter the splicing sequence (striking the web onto the surface of the machine reel and cutting the web) is conducted when the full machine reel is in the correct position. The timing of the splicing command is set in such a way that the end point of the web, whereafter the web can no longer get loose from the reel, is brought as close to the surface as possible.

BRIEF DESCRIPTION OF THE DRAWINGS

In the following, the invention will be described in more detail with reference to the appended drawings, in which.

DETAILED DESCRIPTION OF THE PREFERRED EMBODIMENTS

Figure 1:
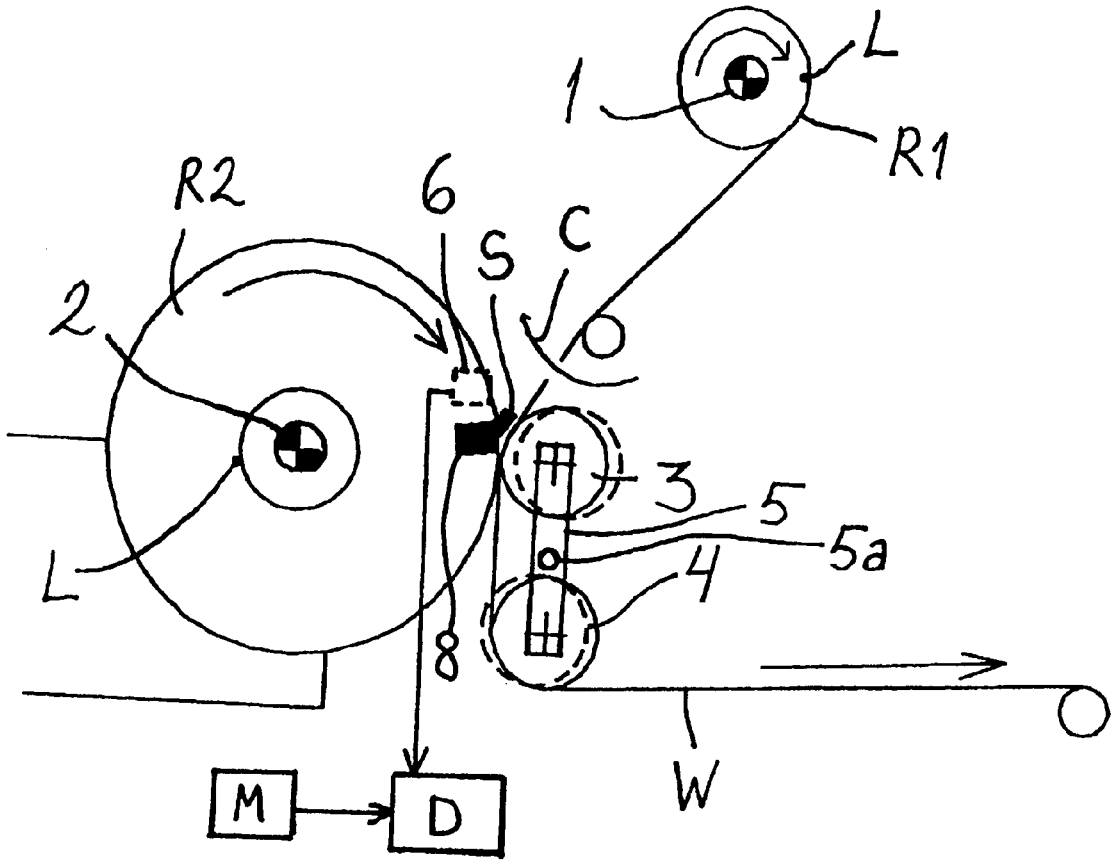
FIG. 1 shows a side-view of the apparatus according to the invention.

FIG. 1 shows a side-view of an apparatus, which is of the type presented in the aforementioned Finnish patent 100323. In the apparatus, a web W is continuously discharged from machine reels brought thereto, the machine reels being produced at an earlier reeling stage, and the web is passed on to a finishing device of the paper web, for example to a coating machine. The apparatus is provided with a secondary drive 1, which rotates a machine reel R1 that is becoming empty, and with a primary drive 2, which rotates a new, full machine reel R2 that has been brought to the apparatus. The main principle of a continuous unwinding is to bring reels successively to the apparatus in such a manner that the full reel is brought to be rotated by the primary drive 2, its paper web is attached to the web W issued from the reel that is becoming empty, which web W is then cut, whereafter the web is discharged from the full reel rotated by the primary drive 2. When there is a certain amount of web left on the reel rotated by the primary drive 2, it is transferred to be rotated by the secondary drive 1, and a new, full reel is brought to the primary drive, whereafter the webs are attached to each other again in the above-described manner. The transfer of the full reel to the primary drive, the removal of the empty reel from the secondary drive and the change of the reel being unwound from the primary drive to the secondary drive can be performed by using known solutions, and since they are not part of the invention, they will not be described in more detail in this context.

FIG. 1 describes a change situation, in which the web of the full machine reel R2 that has been brought to the primary drive in a primary station is joined to a web discharged from the machine reel R1 that is becoming empty at the secondary drive 1 in the secondary station. The circumference of the full machine reel R2 is bounded by a splicing station provided with a splicing roll 3 guiding the web W discharged from the reel R1 that is becoming empty in close proximity to the outer surface of the circumference in the full machine reel R2 rotated by the primary drive 2, in such a way that a splicing gap of a given width is formed between the web and the machine reel R2. In the situation of FIG. 1, the splicing is performed by striking the splicing roll 3 rapidly towards the opposite surface of the reel, wherein the splicing gap is closed. The splicing stroke is synchronized by striking the web W against the surface of the full machine reel R2 when the attachment point on the surface of the reel, for example a splicing tape, enters the splicing station. This point is marked with the letter S. The tape assembly in question can be for example a tape assembly in the transverse direction of the web by means of a tape whose both sides are adhesive, the tape assembly being attached to the end of the web of a full machine reel R2 and having typically the shape of a saw blade or the like for the purpose of improving the grip. Furthermore, the cutting of the web to be discharged is conducted in a synchronized manner with the splicing stroke by utilizing a cutting device illustrated by arrow C, which cutting device performs the cutting stroke and is located before the splicing roll 3 in the travel direction of the web. The cutting device can be e.g. a striking blade cutter. The drawing also illustrates an auxiliary roll 4 cooperating with the actual splicing roll 3 and guiding the discharged web W after the splicing station (splicing gap). The auxiliary roll is attached together with the splicing roll 3 to a common lever 5 articulated at a point of articulation 5*a* located between the axes of the rolls 3 and 4. When the splicing roll 3 is struck on the surface of the full machine reel R2 by means of an actuator (not shown), the motion is transmitted to the auxiliary roll 4 by means of the lever, this motion of the auxiliary roll backwards along a path determined by the point of articulation compensating the stretch otherwise produced on the web.

In FIG. 1, full lines illustrate a situation where the web W is struck against the surface of the reel R2 by means of the splicing roll 3 to form a splicing nip, and the point of attachment S is entering the nip into contact with the web W travelling on the surface of the splicing roll 3. The initial situation where there is a splicing gap between the splicing roll 3 and the reel R2, is illustrated by means of broken lines.

After the web discharged from the reel R1 becoming empty has been cut, part of the web still remains around the spool constituting the core of the reel, and it tends to continue its motion towards the splicing station, the shred, chaff etc. discharged therefrom causing problems. According to the invention, the amount of dischargeable web is minimized in such a way that the terminal end point of the web is attached for example by means of a glueing or a taping L provided on the bottom of the reel. This point is also entered in a readable memory M, which is connected to an electronic control unit D. When the web is discharged from the reel R1, the distance travelled by the web is determined by means of a device for determining the distance by utilizing the locating marks on the edge of the web, which have been stored in the memory to synchronize the memory and the distance travelled by the web is compared with the memory M.

In determining the distance i.e. the length travelled by the web, it is possible to utilize the measurement of a variable which is directly proportional to the length of the web such as time, i.e. the length is known when the running speed and the time elapsed is known. There are also other possible ways of determining the length, such as direct length measurement.

The electronic control unit D, which has the date of the length of the web, gives a signal when there is a certain amount of web remaining on the reel that is becoming empty, and this signal can be given by means of the thickness measurement of the reel R1 known as such or the distance information of the memory M. Because of the signal, the primary drive 2 of the full reel R2 accelerates the reel into the web speed, i.e. its peripheral speed is increased to be equal to the speed of the web that is being discharged. The location (angular position) of the atachment point S on the surface of the full reel R2 is monitored for example by means of a sensor 6 located in the vicinity of the rotating reel, the sensor transmitting the information to the control unit D. The location of the atachment point can be marked in a suitable manner in the reel by means of one or more locating marks (8) in such a way that the sensor 6 can give unambiguous information on the location of the point S at a given time. The splicing is conducted under the control of the control unit when the following conditions are fulfilled successively:

1) Comparison with the memory M indicates that the distance to the terminal end point L equals a predetermined minimum length (splicing command), and
2) The attachment point S of the full machine reel R2 lies in such an angular position with respect to the splicing station that the slicing stoke can be conducted (splicing mark).

To implement a reliable function, the splicing can be performed in such a manner that the splicing stroke is conducted only at the second splicing mark after the splicing command. The set minimum distance to the terminal end point L, when measured from the point where the web departs from the reel R1 that is becoming empty, can be twice the peripheral length of the full reel R2 with an added given safety distance corresponding to the error tolerance of the length measurement, which is, in any case, smaller than the peripheral length, and 3 m at the most. The error tolerance sufficient for the length measurement is advantageously only 2 m.

Figure 2:
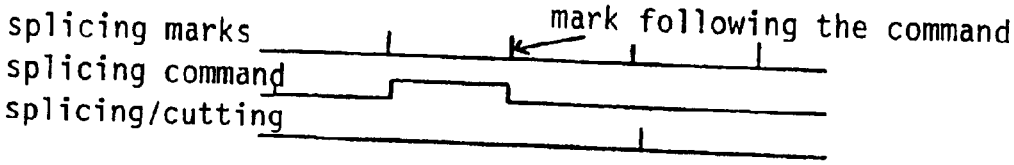
FIG. 2 illustrates the timing of different commands in connection with the splicing process.

FIG. 2 illustrates the progress of the splicing stage. On each revolution of the full reel R2, the splicing mark is obtained when the sensor 6 indicates that the attachment point S is in the correct position. The splicing command may be given at any time between two splicing marks, or simultaneously with a splicing mark. The splicing (splicing stroke and cutting of the web) is performed at the second splicing mark after the splicing command. The first splicing mark follows after the splicing command or occurs simultaneously with the same.

Thus, if the minimum distance to the terminal end point L that triggers the splicing command, i.e. the minimum length of the web W remaining on the reel R1, is twice the peripheral length of the full reel R2 plus the safety distance, it is possible to ensure that the web W on the reel does not run out before the splicing, because the reel R may rotate yet two revolutions at the most before the splicing. Thus, the length of the web left after the cutting around the reel spool is in its minimum, i.e. it is only the aforementioned back-up distance+length measurement error+distance from the discharge point to the cutting point determined by the cutting device C. When a safety distance of 2 m is used, the length of the web which tends to be discharged from the cutting point towards the splicing station is only the aforementioned 2 m, if the length measurement error=0. Correspondingly, if the splicing command is given immediately before the splicing mark or simultaneously with the splicing mark, the full reel R2 rotates only one revolution, wherein the amount of web remaining on the reel R1 equals one peripheral length of the full reel R2+safety distance. This maximum amount is considerably small when compared even to the optimal amount obtained with the present methods. For example with the peripheral length of the machine reel of 11 m and with a safety distance of 2 m (length measurement error=0), the amount that tends to be discharged towards the splicing station is only 13 m, which is less than one third of the amount obtainable with the present methods (45 m). This length can be easily controlled by means of air jets or other auxiliary means, by means of which the travel of the web to the nip between the reel and the splicing roll is prevented.

Figure 3:
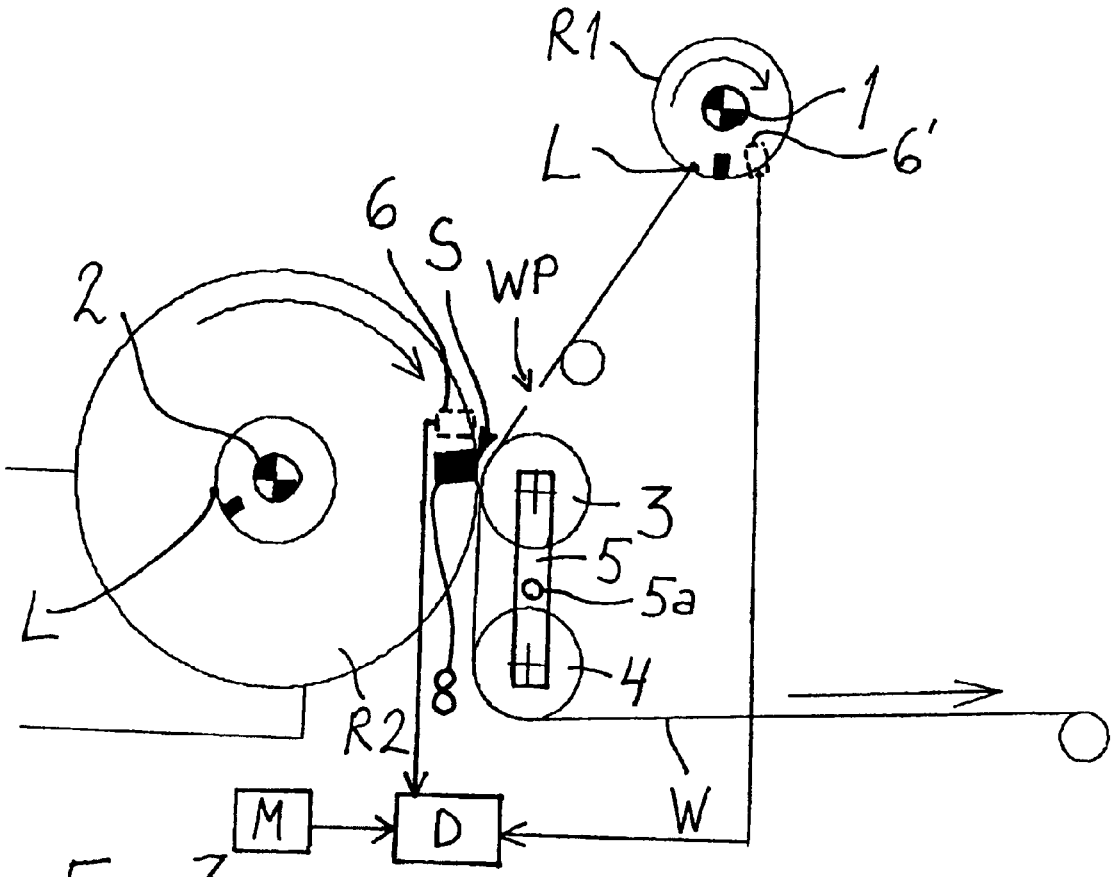
FIG. 3 shows the apparatus of FIG. 1 in a situation where another method is applied.

FIG. 3 presents an embodiment developed from the embodiment of FIG. 1. Here, the splicing principle and the measuring procedures are the same as those presented in FIG. 1, and the same parts are marked with the same reference numerals as in FIG. 1. The essential idea of the method is that the rotation of the full reel R2 and the reel R1 that is becoming empty is synchronized in such a way that the splicing mark is obtained when there is less than one revolution of web W remaining on the reel R1 to the terminal end point. FIG. 3 illustrates an ideal situation where the terminal end point L is located at a point where the web departs from the reel R1, i.e. there is no dischargeable web left. Thus, the web W is taut between the splicing station and the core of the reel R1, and a separate cutting device is not necessarily required, but the web W is provided with a weakening P, at which point the web breaks as a result of the draw. This weakening is provided in the reel in connection with the formation of the reel at a distance from the terminal end point L, which is smaller than the distance between the core of the reel and the splicing nip in the unwind. Thus, the paper web W breaks in the point located before the splicing nip, when it is taut straight in a linear position between the core of the reel R1 and the splicing nip.

The transverse weakened point is obtained in the paper web by pressing the web against a surface with a transverse member, for example a perforating blade, in the rereeler preceding the unwind.

In practice, the synchronization of the rotation of the reels is implemented in such a way that the web is discharged at the running speed from the reel R1 that is becoming empty, and then on the basis of the length determination data obtainer on the traveling web, information in the memory M and the position information given by the sensor 6, the rotation of the full reel R2 is synchronized in such a manner that the attachment point on its surface is in the correct position in view of the slicing at that stage when there is a predetermined minimum amount of web remaining on the reel R1. The reel R1 that is becoming empty can also be provided with locating mark/marks (10) to facilitate this synchronization, wherein the secondary station also comprises a measuring device indicating the position of these marks. FIG. 3 shows a sensor 6 connected to the control unit D, by means of which sensor the position of the locating mark/marks (10) is monitored. The locating mark/marks (10) can be fixed e.g. to the end of the reel spool.

It is possible that in the alternative shown in FIG. 3, a longer "tail" of the old web remains parallel with the new web discharged from the full reel R, because the distance to the weakening WP from the splicing point determined by the attachment point S can be longer than that shown in the situation of FIG. 3, if there is still web left on the reel R1.

Figure 4:
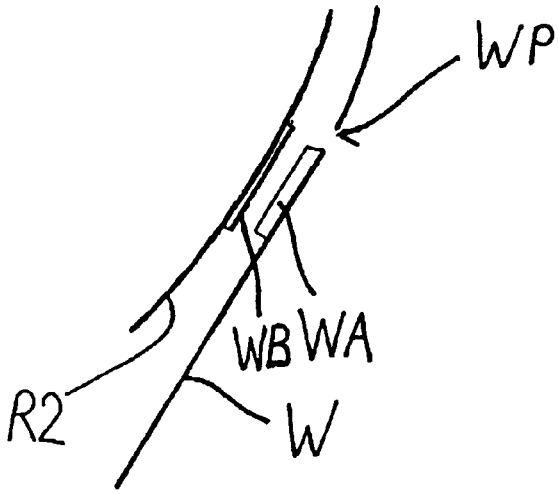
FIG. 4 illustrates the provision of a special attachment point in a reel that is becoming empty.

FIG. 4 illustrates the possibility of making such a tail neat by producing a transverse adherent area WA in the point located before the weakening WP in the discharge direction of the web, the surface of the adherente area being capable of adhering to the surface of the web discharged from the reel R2 after the splicing point. As can be seen in FIG. 4, the area can be formed of a transverse strip whose surface is provided with a substance capable of adhering to the paper web. For example, the strip can be made of two-sided adhesive tape, which is positioned parallelly to the weakened point. To prevent the area WA from adhering to the bottom of the reel R1, the reel can be provided with a release area WB opposite the adherent area. The surface of the release area is of suitable material, such as silicone, used for example in release papers. Such a release material can also be attached as a strip on the bottom of the reel by means of glue.

As can be seen in the drawings, in the bottom of each reel to be reeled in the unwind, there is a terminal end point L entered in the memory such as a fault map, possibly a weakened point WP and an adherent area WA and on the surface of the reel an attachment point S for splicing.

The invention is not restricted to the embodiments described above, but it can be modified within the scope of the inventive idea presented by the claims. As a readable memory it is possible to use a fault map describing the quality of the formed reel at different points, the fault map being supplemented with the location of the terminal end point L. In the longitudinal direction of the paper web W there are pacing marks, marked for example on the edge of the paper web, which pacing marks can be detected by the device from the web that is being discharged for determining the distance travelled. The invention is not, however, restricted solely to the use of pacing marks in the determination of length. In its simplest form the memory can be merely a numerical value,.which indicates the distance from an easily recognizable point in the web on the reel to the terminal end point L, wherein the distance travelled by the web after this point is measured and compared to the aforementioned stored numerical value.

What is claimed is:

1. A method for unwinding a paper web, in which a first paper web is discharged at a discharged point from an emptying reel that is becoming empty and a second paper web from a new full reel having an attachment point of a leading end of said second paper web is spliced to said first paper web at the discharge speed of the first paper web, comprising the steps of:

storing in a readable memory a position of a terminal end point of said first paper web in a longitudinal direction of said first paper web;

determining a distance traveled by said first web during said discharge;

comparing said distance traveled to said position of said terminal end memory; and generating a splicing command for splicing the leading end of said second paper web of said full reel to said first paper web being discharged when there is a predetermined length of said first paper web remaining reeled on said emptying reel prior to said terminal end of said first paper web.

2. The method according to claim 1, wherein said splicing command is given when a length from the discharge point to said terminal end point is less than three times a peripheral length of said full reel.

3. The method according to claim 2, wherein said splicing command is given when said amount of said first paper web remaining on said emptying reel is twice said peripheral length of said full reel plus a safety distance of no more than 3 meters, preferably no more than 2 meters.

4. The method according to claim 2, further comprising the steps of:

registering at least one splicing mark representing an angular position of the attachment point of said full reel for each revolution of said full reel; and wherein said splicing occurs at said at least one splicing marks.

5. The method according to claim 4, wherein a first splicing mark is registered simultaneously with said splicing command or thereafter, a second splicing mark is registered next after the first splicing mark, said splicing occurring at said second splicing mark.

6. The method according to claim 1, further comprising the step of:

synchronizing the rotation of said full reel by reading said memory prior to splicing, such that an attachment point on a surface of said full reel enters a splicing station when there is a predetermined minimum length of said first paper web remaining reeled on said emptying reel prior to said terminal end point.

7. The method according to claim 6, wherein said minimum length of said first paper web is equal to a distance of at most one revolution around said emptying reel.

8. The method according to claim 6, wherein said first paper web is provided with a weakening point along its length, located before said splicing station at a moment of splicing, whereby said first paper web breaks at the location of said weakening point.

9. The method according to claim 8, wherein said first paper web is provided with an adherent area which adheres to said surface of said first paper web of said full reel after said attachment point, said adherent area located in a discharge direction before said weakening point.

10. The method according to claim 1, further comprising the step of:

determining said terminal end point of said first paper web of said emptying reel, at a reel formation stage that precedes the unwinding, by attaching said first paper web to a bottom of said emptying reel to an attachment point and storing said attachment point as a position information in the longitudinal direction of said first paper web in said readable memory which describes said emptying reel.

11. The method according to claim 1, wherein said readable memory is a fault map describing the quality of said emptying reel at different points and produced at a reel formation that precedes said unwinding.

12. An apparatus for unwinding a paper web, comprising:

a first paper web reeled on to an emptying reel;

means for rotating said emptying reel;

means for guiding said first paper web, being discharged from said emptying reel, via a splicing station;

a second paper web reeled on to a full reel, wherein said full reel is structured and arranged such that an outer circumference of said full reel is bounded by said splicing station;

means for rotating said full reel;

a splicing device structured and arranged to splice said second paper web from said full reel to said first paper web being discharged form said emptying reel;

a memory device, wherein a distance to a terminal end point of said first paper web of said emptying reel is stored as information indicating a position of said end point in a longitudinal direction of said first paper web based on an overall length of said first paper web;

a distance determination device for determining a distance traveled by said first paper web; and a control unit connected to said distance determination device and to said memory device, said control unit being structured and arranged to read said memory device and compare said distance by said first paper web to said distance to said terminal end point, wherein said control unit is structured and arranged to give a splicing command when a predetermined length of said first paper web to said terminal end point remains reeled on said emptying reel.

13. The apparatus according to claim 12, further comprising:

a first sensor connected to said control unit, structured and arranged to indicate a position of at least one locating mark attached to said full reel, said first sensor being provided in a primary station of said full reel.

14. The apparatus according to claim 13, further comprising:

a second sensor connected to said control unit, structured and arranged to indicate a position of at least one locating mark attached to said emptying reel, said second sensor being provided in a secondary station of said emptying reel.

15. The method according to claim 12, wherein said distance determination device is structured and arranged to detect locating marks provided at different locations in a longitudinal direction of said first paper web, wherein said memory device contains information regarding said locating marks.

16. The apparatus according to claim 12, further comprising:

a first sensor connected to said control unit, structured and arranged to indicate a position of a plurality of locating marks attached to said full reel, said first sensor being provided in a primary station of said full reel.

17. The apparatus according to claim 16, further comprising:

a second sensor connected to said control unit, structured and arranged to indicate a position of a plurality of locating marks attached to said emptying reel, said second sensor being provided in a secondary station of said emptying reel.

18. The apparatus according to claim 12, wherein the splicing device is a splicing roll.

* * * * *